US005524586A

United States Patent [19]

Mallen

[11] Patent Number: 5,524,586

[45] Date of Patent: Jun. 11, 1996

[54] METHOD OF REDUCING EMISSIONS IN A SLIDING VANE INTERNAL COMBUSTION ENGINE

[75] Inventor: Brian D. Mallen, Charlottesville, Va.

[73] Assignee: Mallen Research Ltd. Partnership, Charlottesville, Va.

[21] Appl. No.: 504,016

[22] Filed: Jul. 19, 1995

[51] Int. Cl.[6] ..... F02B 53/02

[52] U.S. Cl. ..... 123/219; 123/243

[58] Field of Search ..... 123/216, 219, 123/243, 430

[56] References Cited

U.S. PATENT DOCUMENTS

| | | | |
|---|---|---|---|
| 1,102,742 | 7/1914 | Hauer . | |
| 1,102,746 | 7/1914 | Hauer . | |
| 1,269,937 | 6/1918 | Hutsell . | |
| 1,492,456 | 4/1924 | Hansen-Ellehammer . | |
| 1,605,912 | 11/1926 | Barker . | |
| 1,735,477 | 11/1929 | Stuart . | |
| 1,758,320 | 5/1930 | Hoss . | |
| 1,914,091 | 6/1933 | Hamilton et al. . | |
| 2,374,445 | 4/1945 | McFarland . | |
| 2,435,476 | 2/1948 | Summers . | |
| 2,556,313 | 6/1951 | Adams et al. . | |
| 2,974,603 | 3/1961 | Fraser . | |
| 2,985,110 | 5/1961 | Burt et al. . | |
| 3,180,271 | 4/1965 | Hartmann . | |
| 3,221,665 | 12/1965 | Hartmann . | |
| 3,301,233 | 1/1967 | Dotto et al. | 123/243 |
| 3,407,742 | 10/1968 | Mitchell et al. . | |
| 3,437,079 | 4/1969 | Odawara . | |
| 3,516,769 | 6/1970 | Korhonen . | |
| 3,548,790 | 12/1970 | Pitts . | |
| 3,809,020 | 5/1974 | Takitani . | |
| 3,820,515 | 6/1974 | Knisch . | |
| 3,869,231 | 3/1975 | Adams . | |
| 3,929,105 | 12/1975 | Chisholm | 123/243 |
| 3,964,447 | 6/1976 | Normandin . | |
| 4,075,981 | 2/1978 | Durst . | |
| 4,103,666 | 8/1978 | Shimoji et al. | 123/219 |
| 4,230,088 | 10/1980 | Southard . | |
| 4,241,713 | 12/1980 | Crutchfield . | |
| 4,353,337 | 10/1982 | Rosaen | 123/243 |
| 4,355,965 | 10/1982 | Lowther . | |
| 4,401,070 | 8/1983 | McCaan . | |
| 4,638,776 | 1/1987 | Crittenden . | |
| 5,211,147 | 5/1993 | Ward | 123/418 |
| 5,277,158 | 1/1994 | Pangman . | |
| 5,429,084 | 7/1995 | Cherry et al. . | |

FOREIGN PATENT DOCUMENTS

| | | |
|---|---|---|
| 860545 | 9/1939 | France . |
| 1915976 | 10/1969 | Germany . |
| 116414 | 5/1946 | Sweden . |
| 8707675 | 12/1987 | WIPO . |

*Primary Examiner*—Michael Koczo
*Attorney, Agent, or Firm*—Lagerman & Jones

[57] ABSTRACT

A method for reducing the exhaust pollution emissions in a sliding vane internal combustion engine. First, an ultra-lean fuel-air combination is thoroughly premixed, the fuel-air combination having an equivalence ratio less than about 0.60 and a dimensionless concentration fluctuation fraction below about 0.33. After being premixed, the ultra-lean fuel-air combination is inducted into a vane cell, compressed, and it is then combusted at a peak compression plateau. The combusted fuel-air combination is purged after an expansion cycle. The combusting of the fuel-air combination may be initiated by autoignition.

16 Claims, 7 Drawing Sheets

METHOD OF REDUCING EMISSIONS IN A SLIDING VANE INTERNAL COMBUSTION ENGINE

BACKGROUND OF THE INVENTION

FIELD OF THE INVENTION

The present invention generally relates to internal combustion engines, and more particularly, to a method of reducing emissions in a sliding vane engine wherein the vanes slide with either a radial or axial component of vane motion.

DESCRIPTION OF THE RELATED ART

The overall invention relates to the class of devices known as internal combustion engines. Internal combustion engines produce mechanical power from the chemical energy contained in the fuel, this energy being released by burning or oxidizing the fuel internally, within the engine's structure.

However, the oxidation of hydrocarbon fuels at the elevated temperatures and pressures associated with internal combustion engines produce at least three major pollutant types:

(1) Oxides of Nitrogen ($NO_x$)

(2) Oxides of Carbon (CO, $CO_2$)

(3) Hydrocarbons (HC)

Carbon dioxide ($CO_2$) is a non-toxic necessary by-product of the combustion process and can only be effectively reduced in absolute output by increasing the overall efficiency of the engine for a given application. The major pollutants $NO_x$, CO, and HC contribute significantly to global pollution and are usually the pollutants referred to in engine discussions. Other pollutants, such as aldehydes associated with alcohol fuels and particulate associated with diesel engines, contribute to global pollution as well. In the last decade it has become clear that the reduction of all such pollutants is of global importance; providing an impetus for advanced research in pollution chemistry and engine design.

Practical engine devices currently include piston engines, Wankel rotary engines, and turbine engines, which may be divided into two fundamental categories: positive displacement engines and turbine engines.

In positive displacement engines (piston and Wankel engines) the flow of the fuel-air mixture is segmented into distinct volumes that are completely or almost completely isolated by solid sealing elements throughout the combustion cycle, creating compression and expansion through physical volume changes within a chamber.

Turbine engines, on the other hand, rely on fluid inertia effects to create compression and expansion, without solidly isolating chambers of the fuel-air mixture. Regarding pollution emissions, turbine engines have to date offered three advantageous features in most applications:

(1) lower peak combustion temperatures;

(2) extended combustion duration; and (3) leaner fuel-air ratio. Because of these three features, pollution emissions of $NO_x$, CO, and HC are normally lower in a turbine engine than a piston engine. The significantly lower peak combustion temperatures-largely provided by the leaner fuel-air ratio-reduce $NO_x$ emissions by reducing the rate of formation of $NO_x$, while the extended combustion duration and leaner fuel-air ratio reduce CO and HC emissions through oxidation of these compounds.

However, one feature of turbines has limited the magnitude of $NO_x$ reduction in most applications to date, namely that the fuel and air are not able to be adequately mixed prior to combustion. Even if the average peak combustion temperatures are low, inadequate mixing prior to combustion will significantly limit the degree of $NO_x$ reduction.

Certain recent developments in the field of gas turbines, such as the turbine engines incorporating the "Double-Cone" burner, provide sophisticated means to allow adequate premixing of fuel and air prior to combustion, and have in actual testing proven the validity of the theories supporting premixing as important to reducing $NO_x$ emissions. Thus, designs have been recently developed within the turbine engine field which simultaneously reduce $NO_x$, CO, and HC emissions to less than 25 parts per million each, or roughly a factor of 100 below the modern spark ignition piston engine.

Turbine engines, however, are not practical for many applications (e.g. automobiles) because of high cost and/or poor partial power performance, leaving positive displacement engines such as the piston and Wankel designs for these applications.

Commercially available piston and Wankel designs offer poor emissions performance and require catalytic converters to reduce emissions. Even with catalytic converters, pollutant output is substantially higher than desired, being on the order of several hundred to several thousand parts per million of $NO_x$, CO, and HC for most applications. In addition, a major drawback of the use of catalytic converters is that their effectiveness weakens over time, requiring inspection and replacement to maintain performance.

In light of the foregoing, there exists a need for a method of reducing emissions in a positive displacement engine towards the scale of the aforementioned advanced turbine engines, but without the need for catalytic converters.

SUMMARY OF THE INVENTION

Accordingly, the present invention is directed to a method of reducing exhaust pollution emissions in a positive displacement sliding vane engine that substantially obviates one or more of the problems due to the limitations and disadvantages of the related art. Specifically, the engine is a sliding vane engine, wherein the vanes slide with an axial and/or radial component of vane motion, configured in accordance with the present method to achieve a low or reduced emissions chemical environment with respect to $NO_x$, CO, and HC emissions.

Computer simulations have demonstrated that the present method has the potential to achieve $NO_x$, CO, and HC levels that are all about several hundred ppm or lower—which is roughly a factor of 10 or more below current spark ignition piston engine levels—as determined by established chemical calculations. Such a chemical environment with respect to all of these pollutants is not currently practical with conventional piston engines, diesel engines of all geometries, or Wankel engines. In the context of this invention, low or reduced emissions will be defined as levels of $NO_x$, CO, and HC below that produced by mainstream, conventional spark-ignition piston engines without catalytic converters or exhaust gas treatment.

To achieve these and other advantages and in accordance with the purpose of the invention, as embodied and broadly described, the invention is a method of reducing exhaust pollution emissions in a sliding vane engine, wherein the vanes slide with an radial or axial component of vane motion, the method comprising the steps of:

(1) thoroughly premixing an ultra-lean fuel-air combination, said fuel-air combination having an equivalence ratio less than about 0.60 and a dimensionless concentration fluctuation fraction below about 0.33;

(2) inducting the premixed, ultra-lean fuel-air combination into a vane cell;

(3) combusting the ultra-lean fuel-air combination in the vane cell at a peak compression plateau; and (4) purging the combusted fuel-air combination after an expansion cycle.

With conventional positive displacement engines, a necessary tradeoff of pollutants is encountered as the result of the fundamental chemistry governing emissions output. As an example, running a rich fuel-air ratio, which decreases $NO_x$, can increase CO and HC emissions and vice versa, because the properties of temperature, pressure, and duration often have opposing effects on concentrations of these two sets of pollutants within the environment of such engines. Utilizing the method described for this invention as applied to the vane engine geometry, this heretofore imposition of compromise on emissions performance can be eliminated, and low levels of all major pollutants can be achieved.

The steps of this method cannot be applied to conventional piston or Wankel rotary engines because the high compression duration is governed by geometrical factors and cannot be extended properly within the conventional piston and Wankel geometry.

Other unique features possible with the sliding vane engine design, such as the high power density and short compression and expansion durations, further distinguish the practicality of the vane design to perform at ultra-lean fuel-air mixtures with minimal weight and maximal efficiency. The features of the present method are further summarized below in comparison to conventional engine types.

Regarding the first step of the present method-premixing an ultra-lean fuel-air combination-it is noted that conventional diesel engines do not adequately premix the air and fuel prior to combustion and thus cannot achieve low $NO_x$ emissions.

From a chemical standpoint, adequate premixing of air and fuel prior to combustion is a necessary, though not sufficient, condition to realizing low $NO_x$ emissions in a practical engine design. While diesel engines are characterized by the injection of a lean portion of fuel into the gas that is precompressed to a level sufficient for rapid autoignition, modern studies of achievable mixing rates suggest there is insufficient time for thorough premixing to occur prior to combustion. Thus, though the method of the present invention may utilize autoignition as the principle means of combusting a lean mixture, it is not technically a diesel engine, because fuel in this invention is injected prior to high compression and the fuel-air is then fully mixed prior to combustion.

Importantly, conventional diesel engines do not premix the air and fuel prior to compression because reliable autoignition cannot be maintained without incurring unacceptable preignition as a result of the compression profile mandated by conventional engine geometries.

Regarding the combusting step of the present method, that is, combusting the ultra-lean fuel-air combination in the vane cell at a peak compression plateau, it is noted that conventional spark-ignition engines cannot employ an ultra-lean fuel-air mixture. This is because flame propagation is relied upon as the principle means of combustion, and an ultra-lean mixture does not practically allow for such flame propagation, especially within the very brief peak compression profile of the piston engine geometry. This largely explains why attempts to achieve reliable ultra-lean combustion across a practical range of operating speeds and conditions within conventional piston engines have failed, primarily because the conventional piston engine has no substantive duration at its peak compression region.

In contrast, in the present inventive method, reliable combustion of an ultra-lean fuel-air mixture can be achieved across a practical range of engine speeds and operating conditions in a design which extends the duration of the high compression region beyond that of the piston geometry. This invention may also employ a combustion residence chamber or continuous combustion geometry which also vastly enhances combustion of ultra-lean mixtures and which also cannot be performed within conventional piston and Wankel geometries.

The peak compression plateau is defined as an extended duration at a nearly constant compression ratio, wherein the compression ratio is about at peak compression. The conventional piston engine geometry provides no definite peak compression plateau because the piston is connected to the rotary motion of the crank arm and begins its downward path as soon as it reaches "top-dead-center" or its peak compression.

The present method can be used in conjunction with the sliding vane engine disclosed in U.S. patent application, Ser. No. 08/398,443 (Attorney Docket No. MAL.03) filed Mar. 3, 1995 by B. D. Mallen et al., the entire disclosure of which is hereby incorporated by reference. Portions of the specification of the Mar. 3, 1995 patent application are reproduced in appropriate sections below for ease of reference and discussion.

BRIEF DESCRIPTION OF THE DRAWINGS

The foregoing and other objects, aspects, and advantages will be better understood from the following detailed description of the embodiments of the invention with reference to the drawings, in which.

DETAILED DESCRIPTION OF THE INVENTION

Reference will now be made in detail to an embodiment of a sliding vane engine, an example of which is illustrated in the accompanying drawings, in sufficient detail to appropriately describe the method of the present invention.

In this embodiment, an engine geometry is employed utilizing sliding-vanes which extend and retract synchronously with the rotation of the rotor and the shape of the chamber surface in such a way as to create cascading cells of compression and expansion, thereby providing the essential components of an engine cycle.

Figure 1:
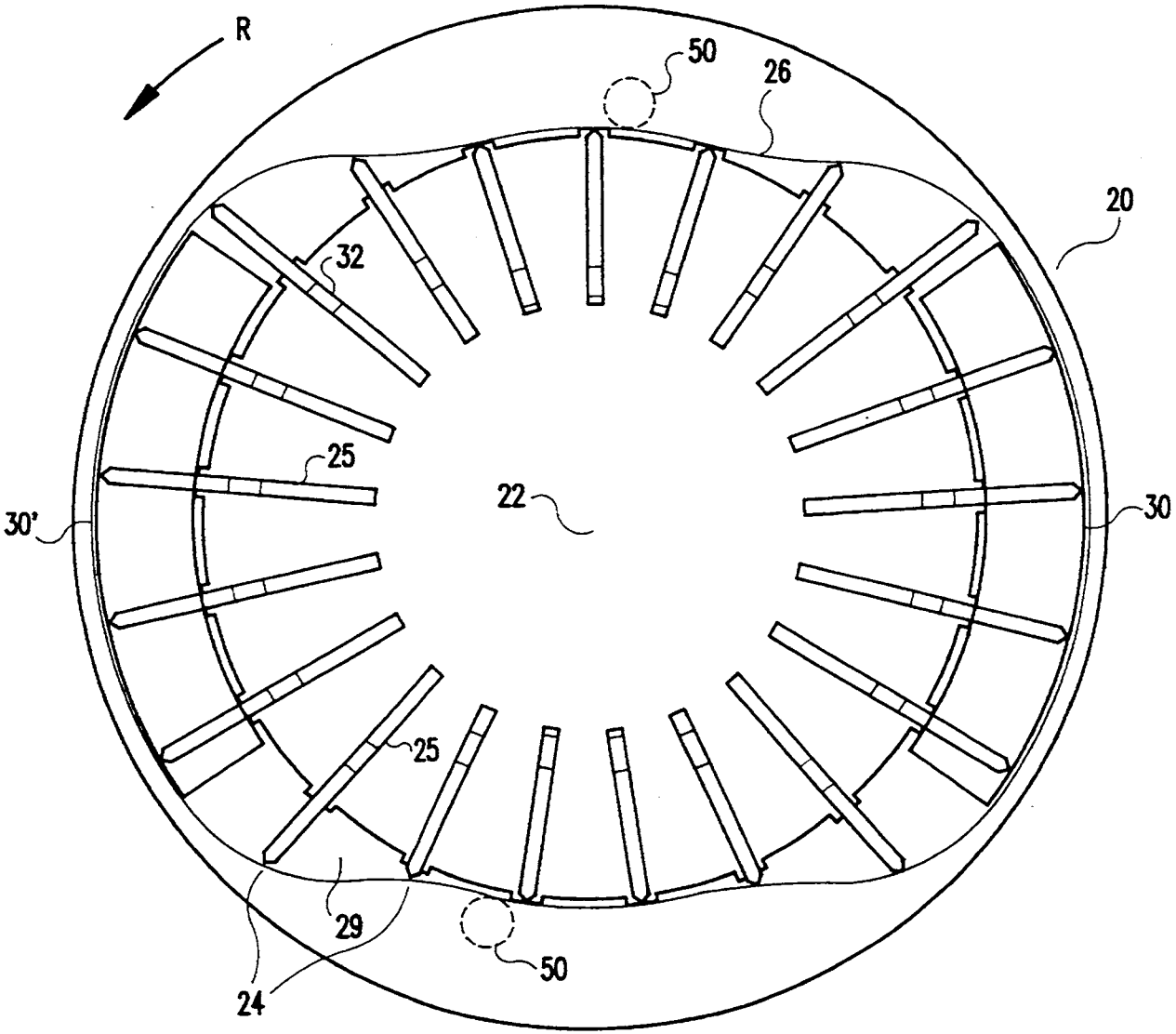
FIG. 1 is a side cross sectional view of a sliding-vane engine with a radial component of motion for the vanes usable with the method of the present invention.

An exemplary embodiment of the sliding vane engine apparatus that may be utilized with the method of the present invention is shown in FIG. 1 and is designated generally as reference numeral 20. The apparatus contains a rotor 22, rotating in a counterclockwise direction as shown by arrow R in FIG. 1. The rotor 22 may also rotate in a clockwise direction. The rotor 22 houses a plurality of vanes 24 which slide within vane slots 25 in a radial direction, the vanes 24 defining a plurality of vane cells 29. A stator 26 forms the roughly elliptical shape of the chamber outer surface.

The illustrated engine employs a two-stroke cycle to optimize the power-to-weight and power-to-size ratios of the engine. The intake of the fuel-air combination and the scavenging of the exhaust occur at the regions of the two outer portions of the chamber shape 30 and 30', which define the intake/exhaust regions of the engine cycle. Two complete engine cycles occur for each revolution of the rotor 22; one commencing with intake at the upper portion of region 30 and exhaust at the upper portion of region 30', and a second commencing with intake at the lower portion of region 30' and exhaust at the lower portion of region 30.

Figure 2:
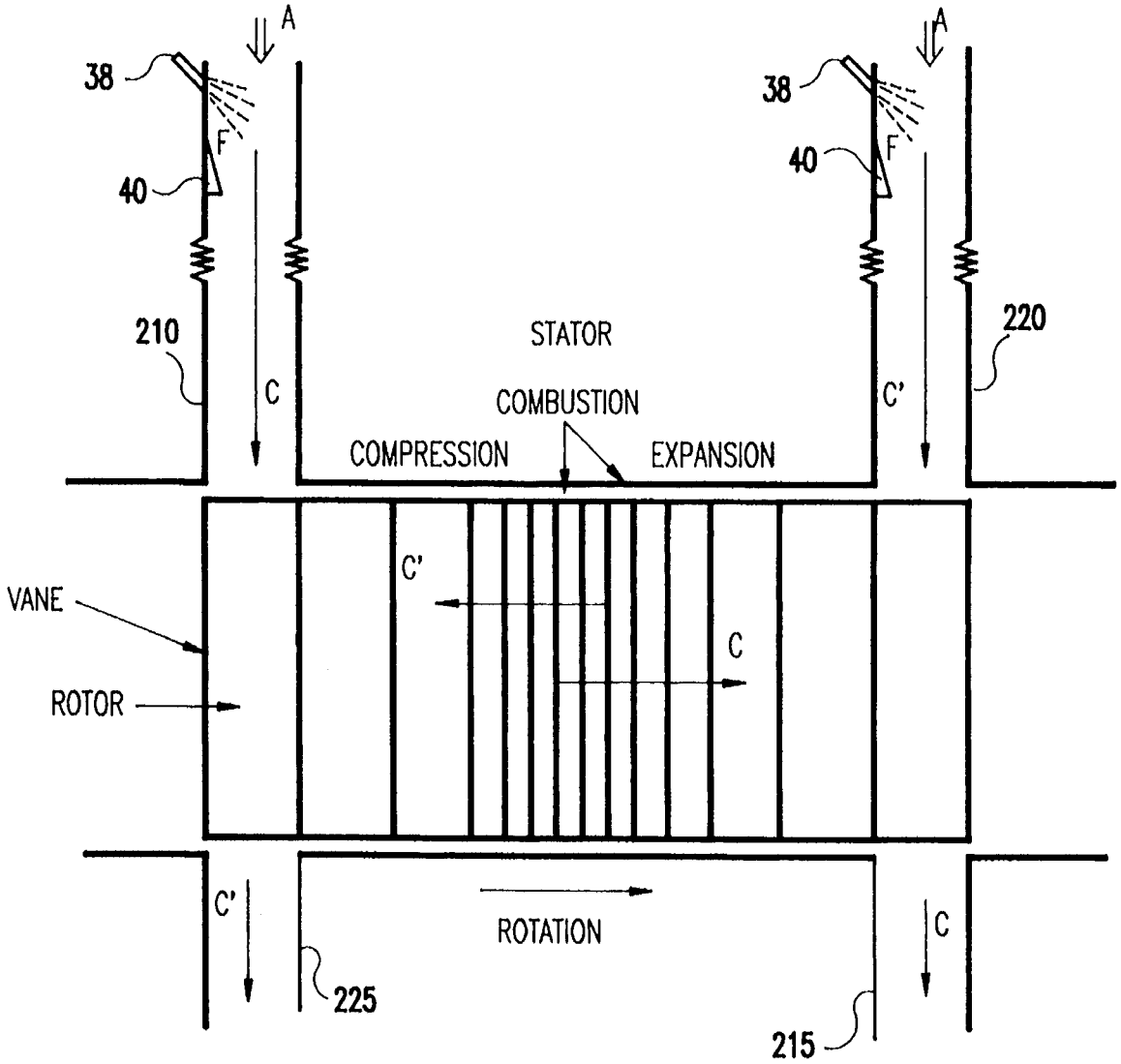
FIG. 2 is a top view of the vane engine illustrating premixing and cross flow through the engine.

As shown in the top view of the vane engine in FIG. 2, in the "upper" cycle, the fuel-air combination C flows through a first intake means 210 at one end of the engine, through the engine in an axial direction, and is exhausted through exhaust means 215 at the other end of the engine. For the second "lower" cycle, the fuel-air combination C' flows though a similar intake means 220 at one end of the engine, through the engine in an axial direction, and is exhausted through a similar exhaust means 225 at the other end of the engine.

The respective intake (210, 220) and exhaust means (215, 225) line up with the intake/exhaust regions 30 and 30' as shown in FIG. 1. The intake and exhaust means may be of various geometries, as for example, circular or square shaped conduits. The size and shape are selected to ensure adequate air flow and fuel mixing in accordance with the present method, which is described in greater detail later in the specification.

As shown in FIG. 2, turbulence-generating devices 40 of any type may be employed before the intake region, during the intake region, or some combination thereof, to thoroughly mix the fuel F (from fuel injector 38) and the air A to achieve a fuel-air combination C or C'. Regardless of their orientation or placement, the turbulence generators 40 function to thoroughly mix the fuel-air combination C or C' prior to combustion.

One means of controlling the sliding motion of the vanes 24 involves pins 32 as shown in FIG. 1, which protrude from either or both axial ends of the vanes. These pins 32 ride within channels incorporated in the fixed end-seal plates of the engine. The channels are not exposed to the engine chamber and can thus be easily lubricated with a dry film, oil, or fuel, or combination thereof, without encountering major lubricant temperature and contamination problems.

For many applications, the tips of the vanes need not contact the chamber surface of the stator 26. Thus, oil lubrication need not be supplied to the stator surface, thereby permitting higher wall temperatures and significantly improved thermal efficiency, as well as reducing hydrocarbon emissions. While the method of the present invention significantly reduces $NO_x$, CO and HC emissions, if a hydrocarbon based lubricant is used at the stator surface, the levels of CO and/or HC emissions may be elevated compared to levels without such lubricant. One of ordinary skill in the art would understand that in addition to minimizing oil lubrication, the designer should seek to minimize wall cooling and related crevice volumes in order to optimize the reduction of CO and HC emissions within the practice of this invention.

Figure 3:
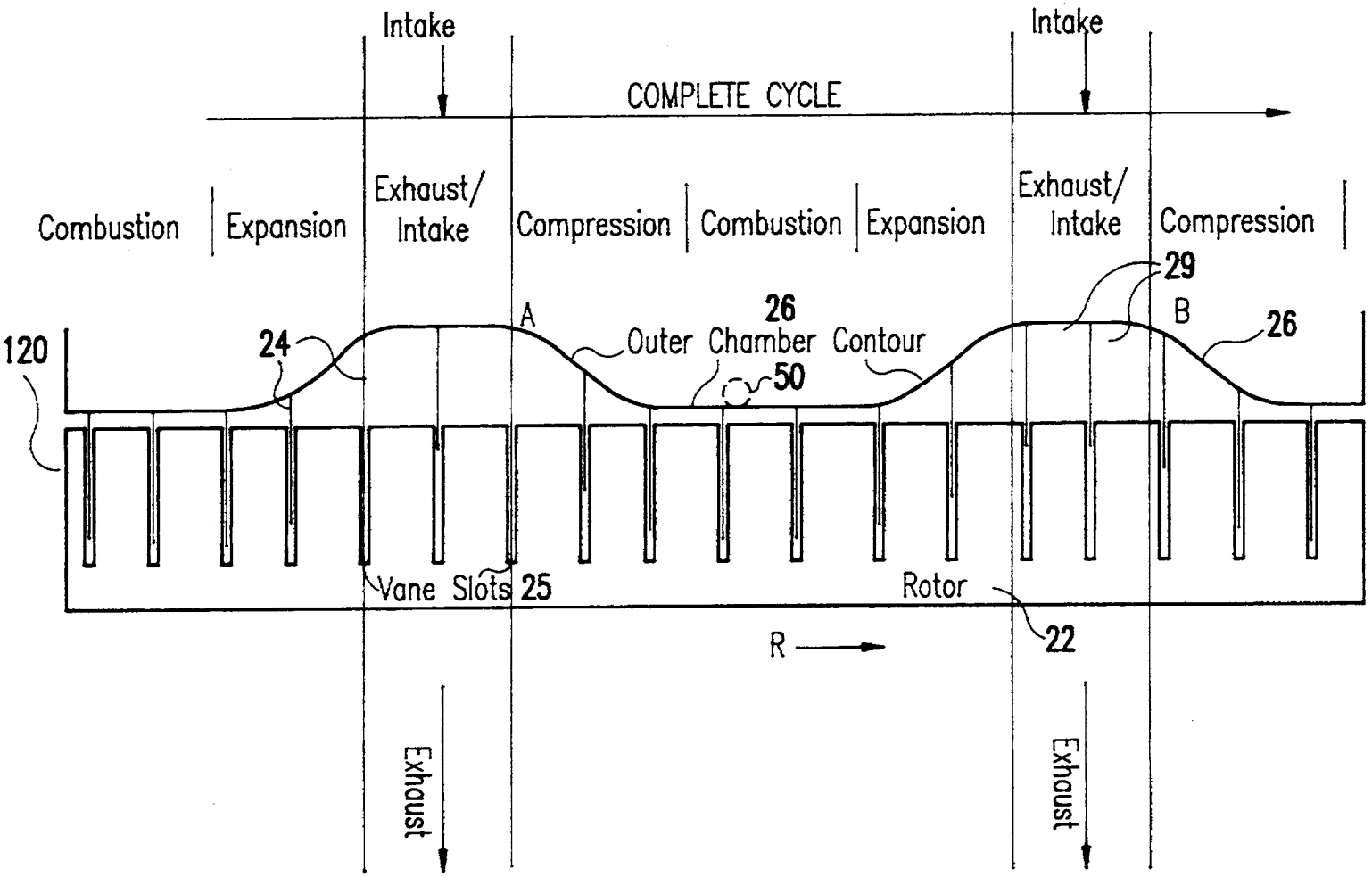
FIG. 3 is a diagram illustrating the stages of intake, compression, combustion, expansion, and exhaust with regard to a straightened rotor shape, which could apply to a sliding-vane engine with an axial, radial, or combination thereof, motion for the vanes.

FIG. 3 illustrates how the embodiment would appear if the rotor were unrolled or straightened. It is thus representative of an alternate embodiment wherein the vanes slide with an axial component of vane motion, or with a vector that includes both axial and radial components. It is apparent that the vanes in FIG. 3 may also be oriented at any angle in the plane illustrated, whereby the vanes would also slide with a diagonal motion in addition to any axial or radial components. Chambers can also be present on both sides of the rotor 22 illustrated in FIG. 3.

The apparatus of FIG. 3 is designated generally as reference numeral 120 and contains the same components as the apparatus of FIG. 1. Wherever possible, the same reference numbers are used throughout to refer to the same or like parts. The apparatus of FIG. 3 contains a rotor 22, rotating in relation to the stator in the direction shown by arrow R. The rotor 22 may also rotate in relation to the stator in the opposite direction. The rotor 22 houses a plurality of vanes 24 which slide within vane slots 25 in a axial direction as illustrated, the vanes 24 defining a plurality of vane cells 29. A stator 26 forms the chamber outer contour surface.

The method may be applied to engines with one or more chambers and may also apply to an engine wherein the relative motion of rotor and stator are maintained, but where the "stator" actually rotates and the "rotor" is actually fixed, or where both rotate in opposite relative motion. The method may also be applied to an embodiment where the rotor envelopes the stator with the vanes pointing radially inward toward the inner stator, which would take the shape of a cam, rather than pointing outward toward a stator shell as illustrated in FIG. 1.

Figure 6:
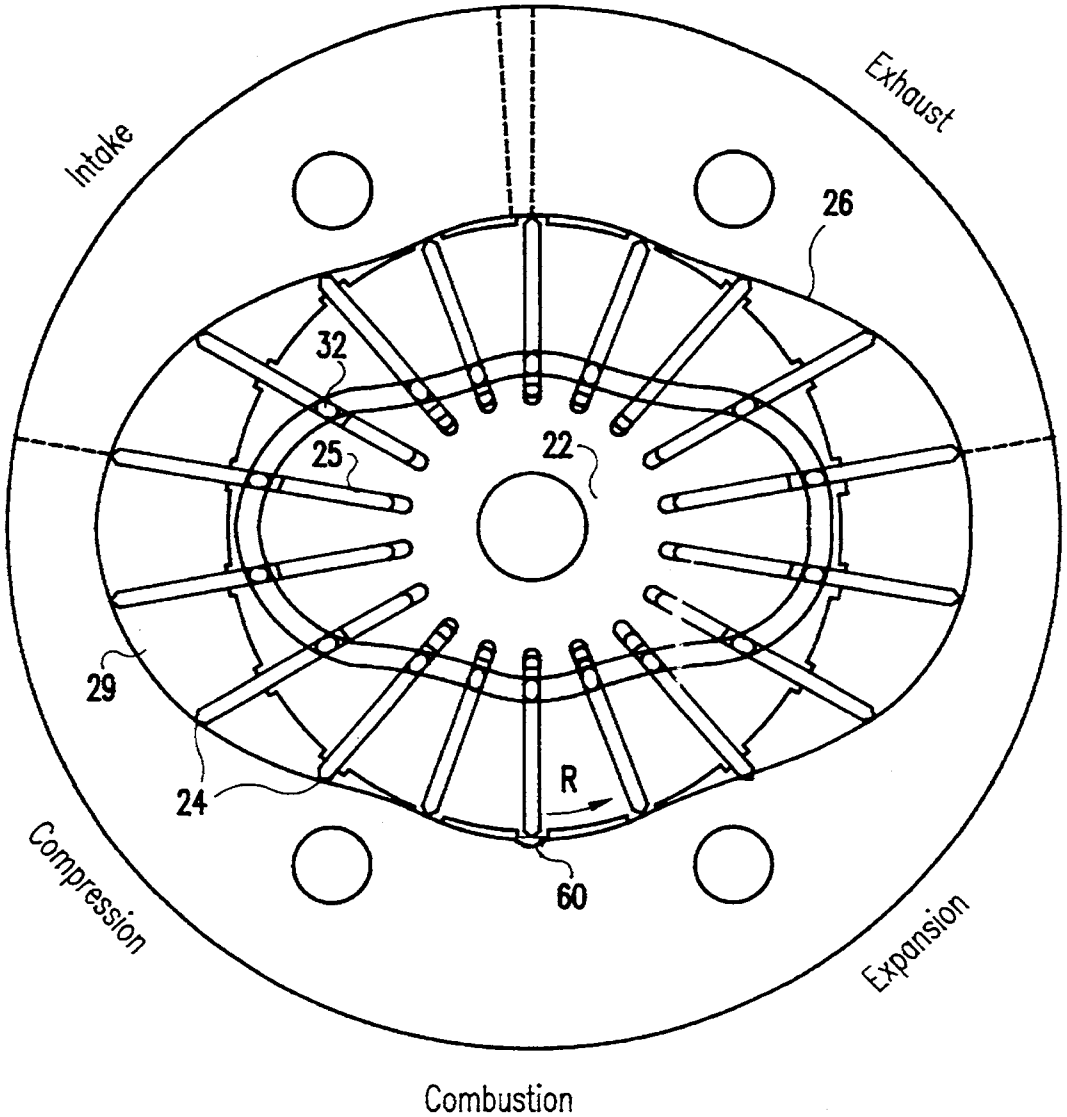
FIG. 6 is a side cross sectional view of a four-stroke sliding-vane engine embodiment illustrating the stages of intake, compression, combustion, expansion, and exhaust.

The complete two-stroke engine cycle is illustrated in FIG. 3, and functions in the same manner as the two-stroke cycle described above with reference to FIGS. 1 and 2, and therefore will not be discussed further here. Note, however, that the steps of this method will apply equally as well to either two-stroke or four-stroke cycles within a sliding-vane engine. A four-stroke cycle is illustrated is FIG. 6, wherein the same reference numbers refer to the same and like parts.

With the above general description of the embodiments providing illustrative examples, the operation of the method according to the present invention will now be described with reference to FIGS. 1 and 2. It is understood that the method applies equally as well to the embodiments of FIGS. 3 and 6. Moreover, the method of the present invention may be used with any type of fuel including, for example, conventional gasoline, alcohol-type fuels such as methanol and ethanol, or hydrogen. For simplicity and ease of discussion, the generic term "fuel" is used throughout the specification.

Referring to FIG. 2, the first method step involves thoroughly premixing an ultra-lean fuel-air combination to achieve a desired premixed fuel-air volume. The fuel F and air A are injected into intake means 210 and 220. It is understood that the fuel F, from fuel injector 38 or example, and air A may be injected separately as shown in FIG. 2, or injected as a combination. Also, the air A may include any gas, for example, fresh air or exhaust gas. The turbulence generating devices 40 then thoroughly premix the fuel and air to produce the desired ultra-lean fuel-air combination C or C'.

In the context of the present method, an "ultra-lean" fuel-air combination, and "thoroughly premixing" are parameters that are chosen to optimize the performance of the present inventive method, and they are defined and discussed more fully below.

A first consideration in determining the optimum fuel-air intake combination and resulting mixture is a reduction in the Zel'dovich mechanism, which is a primary chemical mechanism which produces the bulk of $NO_x$ emissions in most modern engines. This mechanism produces $NO_x$ at a local rate that depends exponentially on the local temperature of the hot gas. Extremely high rates of $NO_x$ formation are generated by the local gas temperatures associated with conventional spark ignition and compression ignition piston engines. Only at local gas temperatures associated with a locally ultra-lean fuel to air ratio can the Zel'dovich $NO_x$ formation be brought to ultra-low rates of formation.

If the mixture ratio of fuel to air is uniform throughout the entire volume of the combustion region, then the rate of $NO_x$ formation would be the same everywhere. Conversely, if the fuel-air mixture is not uniform at the moment of combustion, then the resulting reaction products will exist at varying temperatures, with the hottest parcels of gas producing $NO_x$ at the highest rate. For example, in an engine designed to run with an ultra-lean mixture overall, if a particular parcel of chemical reactants has somewhat more fuel than average, then that parcel will produce a locally hotter chemical product and thus more $NO_x$.

If the mixing is near optimum, then the differences in $NO_x$ production rates will be so small compared to the average production rate that the imperfect mixing will not detectably contribute to the total $NO_x$ production. However, if the mixing is relatively poor, the hottest parcels will be much warmer than the average, producing much greater $NO_x$, than average, and the imperfect mixing will have greatly contributed to the total $NO_x$ production. Therefore it is necessary to achieve an adequate level of premixing prior to combustion in order to avoid the production of additional $NO_x$, even at ultra-lean fuel to air ratios.

A quantitative measure of the effect of nonuniform mixing on the rate of production of $NO_x$ can be estimated by defining a "dimensionless concentration fluctuation" fraction (hereafter D.C.F. fraction). The numerator is the root mean square amplitude of the fluctuations in the local mixture ratio, and the denominator is the difference between the average mixture ratio and the stoichiometric mixture ratio.

When the mixing is indeed perfectly balanced in a lean-burning engine, this fraction is zero, as there are no fluctuations in the local mixture ratio. The Zel'dovich $NO_x$, is then determined by the average mixture ratio. On the other hand, when the mixing is poor, this fraction becomes larger, in extreme cases approaching unity. Then some gas parcels would even reach the maximum possible temperature, the adiabatic flame temperature, consequently generating $NO_x$ at a much greater rate than that of the average mixture.

In order for the mixing quality to be sufficient to minimize $NO_x$ at ultra-lean fuel-air ratios, it is necessary to achieve a value for this fraction of less than about 0.33. For engines which run leaner than stoichiometric, a lower D.C.F. fraction will translate into lowered $NO_x$, emissions, even at small D.C.F. fractions (though with decreasing effects). A general rule would be to limit the D.C.F. fraction to a value of less than 0.10 and preferably less than 0.05. Then the additional contribution to the $NO_x$ formation due to imperfect mixing would be relatively small, which is what the premixing step seeks to achieve.

The D.C.F. fraction of the premixing step may be lowered by steps known to those skilled in the art of fuel-air mixing, such as increasing the duct length to duct height ratio of the mixing duct (i.e., the intake means 210 or 220), increasing the speed of the mixing vortices, or creating greater turbulence within the mixing duct, by adjusting the design (e.g., the slope) or number of turbulence generating devices 40.

Because the peak combustion temperatures are extremely low, around or below about 2250° K., as a result of the ultra-lean mixture, the $NO_x$ emission in this thoroughly-premixed engine will remain extremely low due to the strongly exponential influence of temperature on $NO_x$ formation rates.

An equivalence ratio (E) is used to quantify the air-to-fuel ratio in the mixture ($AFR_m$) compared to the stoichiometric air-to-fuel ratio ($AFR_{stm}$):

$$E=AFR_{stm}/AFR_m$$

The air in the above equation should be taken to be fresh air at ambient conditions. An equivalence ratio of 1.0 provides the amount of fuel which could ideally consume all of the oxygen available in the combustion process, and would thus be the maximum productive fuel to air ratio. By contrast, an equivalence ratio of 0.5 would mean that the fuel could ideally react with only 50% of the available oxygen in the fresh air, leaving the remaining oxygen and other gases in the fresh air to serve as diluent and potential oxidizer.

The ultra-lean fuel-air mixture of this invention should result in an equivalence ratio of less than about 0.60 and preferably less than about 0.50, as compared to premixed fuel-air positive displacement engines which normally operate at equivalence ratios between about 0.8 and about 1.1. Currently, most such automobile engines operate extremely close to an equivalence ratio of 1.0.

Combined with the other steps of the inventive method, the ultra-lean mixture results in a chemical environment in which $NO_x$ emissions remain extremely low and in which the CO and HC can almost entirely oxidize at the combustion site.

In the case that the constituents mixed during the premixing step contain significant exhaust gases or gases other than fresh air which are not included as the combustible fuel, then it is the diluent ratio (DR) and not the equivalence ratio which describes the degree of diluent in the mixture. The diluent ratio DR is expressed as, $$DR=AFR_{stm}/AFR_m$$

where $GFR_m$ is the total non-combustible gas (G) to total fuel (F) ratio of the mixture. As above, the stoichiometric air to fuel ratio is $AFR_{stm}$. Combustible gases, such as hydrogen or methane for example, are considered to be part of the fuel (F) portion, not the gas (G) portion of the mixture.

In this case of incorporating diluents other than fresh air, the diluent ratio should be less than about 0.6, and preferably less than about 0.5. Note, however, that the equivalence ratio in this case (i.e., fuel to fresh air equivalence ratio) should be less than about 1.0 and preferably less than about 0.90, in order to insure that sufficient oxygen is present to permit near-complete combustion of the fuel.

In this case of incorporating diluents other than fresh air, the goal is to achieve the same low peak combustion temperatures through a highly diluted fuel-gas mixture while employing a lean fuel to fresh air equivalence ratio, in order to permit simultaneous minimization of the emissions of $NO_x$, CO, and HC within the described method of this invention.

Returning to the discussion of the method, and referring to FIGS. 1 and 2, the thoroughly premixed fuel-air combination (C or C') is inducted into the vane cell 29. The premixed fuel-air combination is inducted into the vane cell 29 before the compression cycle is well underway. Note that the premixed fuel-air combination need not comprise the entire contents of the vane cell 29, but rather may represent a significant portion. Other constituents may include fresh air and exhaust gas.

In the context of the present method, the passageway formed by the vane cell creates the ideal linear corridor for a two-stroke process because the bulk of the exhaust may be purged without loosing fresh fuel in the process. By contrast, in a conventional piston engine, the two-stroke process dictates that the scavenging flow follow a circuitous route through the cylinder, which results in an inefficient scavenging process. The linear passageway formed by the vanes of the present invention eliminates this inherent shortcoming of the two-stroke piston design.

For such a cross-flow two-stroke embodiment to be optimally controlled with respect to emissions, the cell length should be at least about twice as long as the maximum cell height, so as to improve the scavenging cycle efficiency. Such an improvement will optimize the expulsion of combusted exhaust gas from the vane cell and the retention of non-combusted fresh fuel within the vane cell. The cell height is the height along the path of vane extension, while the cell length is the length perpendicular to the height, taken along the direction of flow through the vane cell. In the case of the radial embodiment of FIG. 1, the cell height is along the radial direction, while the cell length for a cross-flow embodiment would be along the axial direction as shown in FIG. 2.

It is understood, however, that in both the two and four stroke engine embodiments utilized with this method, the intake and exhaust flows may have a radial and/or axial component.

The compression and combustion steps will now be described and some of the terms used herein will be defined. The fuel-air combination C or C' is compressed to about the peak compression level, and that level of compression is maintained for an extended duration. It is understood that this level of compression could be at or near the peak compression level and, tier case of discussion, is referred to generally as "peak compression".

Autoignition, as used here, refers to the rapid combustion reaction which occurs spontaneously as a result of the local temperature, pressure, residence time, and fuel type. The simplest means to achieve this autoignition is to compress the fuel-air mixture until it basically explodes. Other means may also produce autoignition, such as hot gas injection. The important element of the autoignition component is that an ultra-lean fuel-air mixture with a low D.C.F. fraction can be combusted without relying on flame propagation as the principle means of completing the combustion process. The essential reason for the difficulty in achieving flame propagation through an ultra-lean mixture is due to Damköhler number effects. For a discussion of Damköhler number effects, see "Blowout of Turbulent Diffusion Flames," J. E. Browdwell, W. J. A. Dahm, & M. G. Mungel, 20th Symposium (International) on Combustion/The Combustion Institute, 1984, pp. 303–310.

Though a conventional spark may be used in some circumstances to initiate the combustion process, it is expected that other means discussed herein will be used to achieve complete combustion in most applications of this method.

Figure 4A:
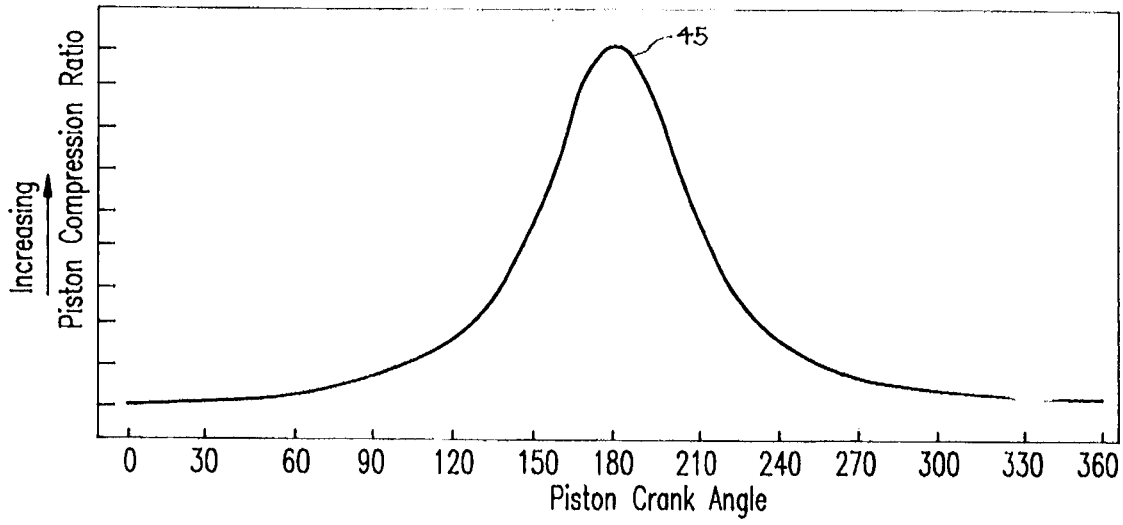
FIG. 4A is a graph depicting a compression ratio profile representative of a conventional piston engine.
Figure 4B:
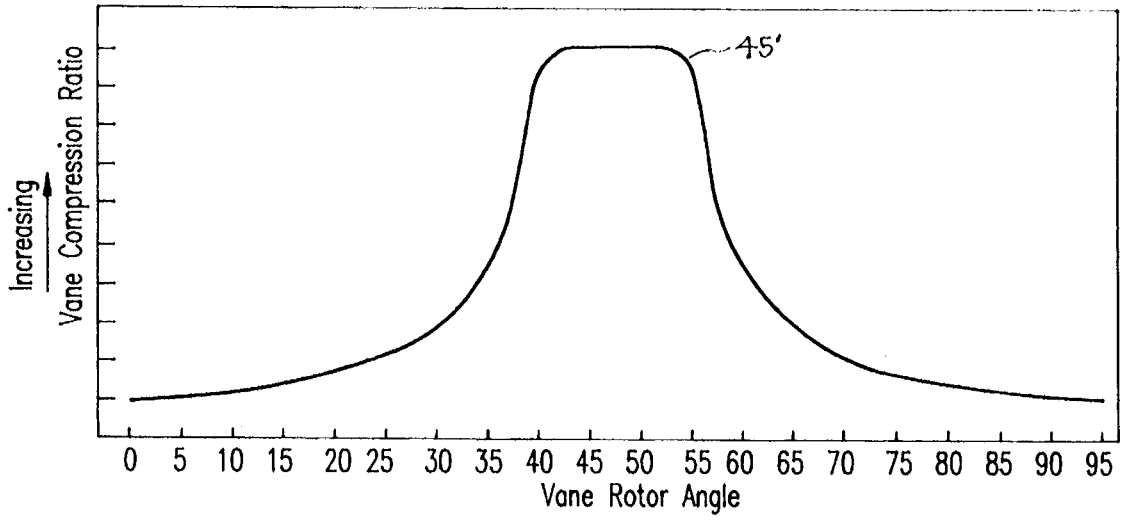
FIG. 4B is a graph depicting a compression ratio profile representative of the present inventive method.

The term "peak compression plateau" is most clearly visualized by a comparison of the compression ratio profile of a conventional piston engine to that of the compression ratio profile of the present inventive method, as shown in FIGS. 4A and 4B. Referring to FIG. 4A, it is readily apparent, and well understood by those of ordinary skill in the art, that the reciprocating motion of the conventional piston design does not provide for any residence time at the peak compression region 45. Note that conventional piston engines have zero duration at peak compression 45, because the piston's motion is determined by the rotation of the crankshaft, and the piston begins its downward motion as soon as it reaches top dead center.

Now, with reference to FIG. 4B, the present inventive method provides an extended duration at the peak compression region, characterized by the peak compression plateau 45', that is maintained for a vane rotor angle of about 15 degrees in the illustrated embodiment. The particular parameters of the extended duration at the peak compression plateau (e.g., the compression ratio and vane rotor angle) may vary considerably within the practice of this invention. What is important is that there be a sufficient extension of duration for the peak compression region so that there is adequate time to permit complete combustion to occur within the peak compression region for a practical range of operating speeds and conditions, with sufficient residence time at this high compression region for the CO and HC pollutants to almost fully oxidize.

Note that the shape and proportions of the cycle, as depicted in FIG. 4B, is more critical than the actual temporal and angular duration of the peak compression plateau. There is no true peak compression duration for the conventional piston engine geometry. The near-peak compression duration of the conventional piston profile of FIG. 4A is about 5% of the compression cycle duration. By contrast, the peak compression duration of the present invention as shown in FIG. 4B is approximately 35% of the compression cycle duration. This much larger proportion allows for the proper compression ratio to be utilized at a given engine speed so that complete combustion of an ultra-lean fuel-air mixture can be achieved, without incurring preignition. Such a result cannot be effectively accomplished within the confines of the conventional piston engine geometry.

Computer simulations reveal that at least about 10% of the compression cycle duration must be devoted to the peak compression plateau in order to achieve proper combustion and emissions performance within the present method. The compression cycle is the portion of the cycle during which active compression occurs.

The peak compression plateau need not be entirely flat, but may be somewhat tapered and/or contoured. It is important, however, that its shape and duration insure near complete oxidation of CO and HC pollutants, without increasing $NO_x$ emissions as a consequence of elevating peak combustion temperatures.

Combustion may also be initiated or facilitated by incorporating a combustion residence chamber or a continuous combustion geometry.

The combustion residence chamber 50 (see e.g. FIGS. 1 and 3) is a cavity or series of cavities which communicates with the fuel-air charge at peak compression and combustion. It may be employed, by way of example and not limitation, to provide high-altitude operation in aviation engines or to reduce the physical duration of the high compression region to improve power density. This cavity may be of variable volume.

Figure 5A:
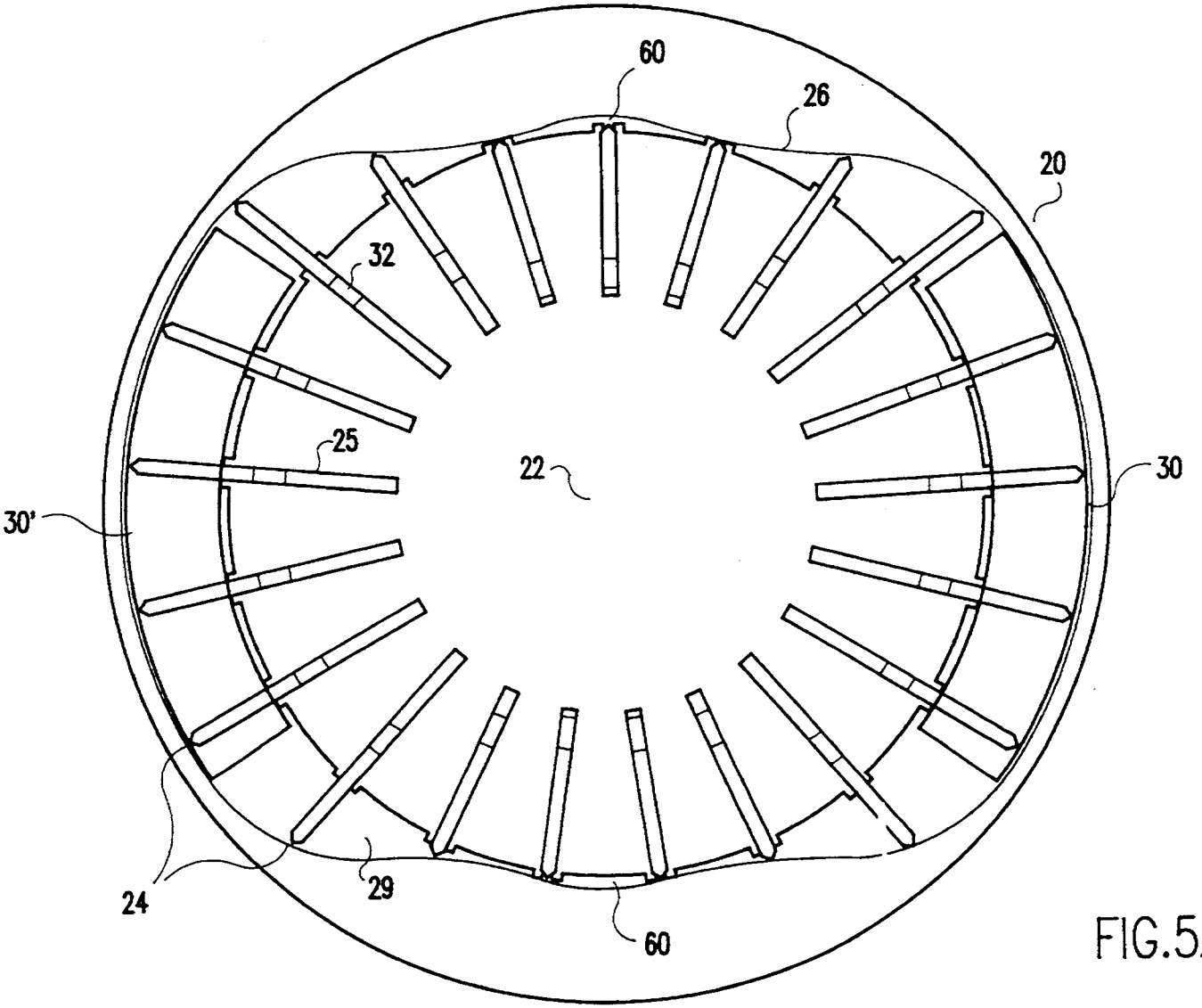
FIG. 5A is an alternate side cross sectional view of a sliding-vane engine illustrating a continuous combustion geometry.

As shown in FIG. 5A, the continuous combustion geometry 60 produces a gap between the vane and chamber wall in a region after combustion has occurred, thereby opening the trailing vane volume to the combustion temperatures and pressures, facilitating rapid combustion. One of ordinary skill in the art would understand that the continuous combustion geometry 60 could take on many geometric forms within the practice of this invention, so long as the trailing vane volume is open to the combustion temperatures and pressures. There may also be an actual retraction of the chamber wall shape to produce this gap. Typically, the stator 26 would be machined accordingly to produce the desired geometry. The vanes need not change position, though they may retract from the chamber surface to produce the same relative retractile gap.

Figure 5B:
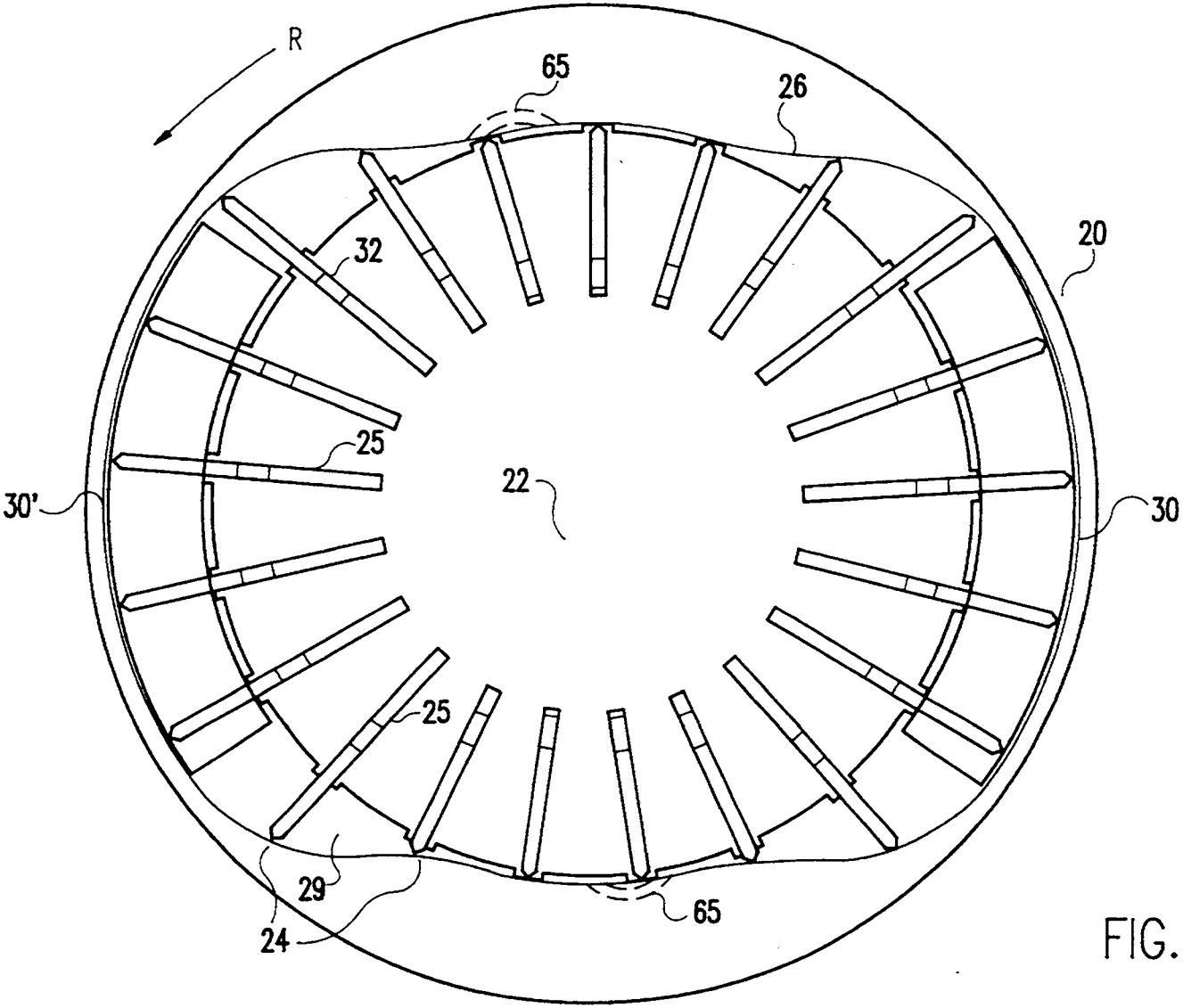
FIG. 5B is an alternate side cross sectional view of a sliding-vane engine illustrating ducting of hot combusted gases into a trailing vane cell.

Alternatively, ducting of hot, combusted gas from the leading vane cell to the trailing vane cell would achieve the same result of opening the trailing vane volume to the combustion temperatures and pressures. This may be accomplished by providing, for example, a porting means 65 through the stator as shown in FIG. 5B.

The compression ratio is chosen so as to avoid autoignition substantially prior to the peak compression region at operating conditions. As stated above, there must be a sufficient extended duration at the peak compression region so that there is adequate time to permit combustion to occur within the peak compression region for a practical range of operating speeds and conditions, with sufficient residence time at this high compression region for the CO and HC pollutants to almost fully oxidize.

The physical duration of the peak compression duration without a combustion residence chamber, continuous combustion geometry, hot gas ducting, or other combustion initiation source or device, will be such that the residence time at peak compression will achieve autoignition and combustion at operational speeds. As indicated in this case, this peak compression plateau duration should be at least about 10% of the compression duration, given that a maximum compression ratio is employed without incurring preignition. The combustion residence chamber 50 and/or the continuous combustion geometry 60 may reduce the physical duration requirement by speeding up the completion of the combustion process.

Larger engines will generally operate at lower rpm than smaller engines, thereby increasing the temporal duration of the peak compression plateau. However, the proportion compared to the compression cycle will remain roughly the same. By way of example and not by limitation, a small vane engine of the type described above may utilize a compression ratio of 18:1 at 5,000 rpm, while a large engine may have a compression ratio of 10:1 at 500 rpm, both compression ratios chosen so as to avoid preignition. Both engines, utilizing the method of this invention, can achieve low pollution emissions because both engines can achieve a cycle shape as generally depicted in FIG. 4B, which includes a peak compression plateau of adequate duration compared to the compression cycle duration.

Because of this geometry and because neither a combustion residence geometry nor a continuous combustion geometry is feasible in conventional piston engines, conventional positive displacement engines cannot reliably combust ultra-lean fuel-air charges within a wide range of operating speeds, temperatures, altitudes, etc., nor can they allow the CO and HC to almost fully oxidize during expansion. As a result of the geometrical limitations, the conventional piston engine cannot simultaneously achieve low $NO_x$, CO, and HC emissions.

Further synergistic advantages stemming from this capability to employ ultra-lean mixtures include the fact that such leaner mixtures reduce the probability of spot-initiated preignition from a hot surface spreading combustion throughout the mixture, because of above-referenced Damköhler number effects. Thus, the present invention permits near-adiabatic operation and/or higher compression ratios to be employed without suffering preignition, thereby improving fuel efficiency and further lowering emissions.

The CO and HC oxidation will typically occur at a temperature range below 2250° K. because of the ultra-lean mixture. The equilibrium values of CO and HC pollutants are extremely low at the combustion temperatures and pressures associated with ultra-lean mixtures. If enough residence time is available at these temperatures and pressures, the mixture will achieve these low equilibrium levels.

Conventional spark-ignition engines have near-adiabatic combustion temperatures of approximately 2850° K. Such high combustion temperatures yield extremely high equilibrium levels of CO which do not have sufficient time during the expansion process to oxidize into $CO_2$, resulting in extremely high CO emissions.

The oxidation of CO into $CO_2$ in this invention will primarily occur prior to the rapid expansion process which invariably changes the oxidation from a desirable equilibrium process to a rate controlled, kinetic process-an effect which occurs with virtually all positive displacement designs. This effect prevents the CO from reaching equilibrium at lower temperature and pressure regions within the expansion process and thus explains why conventional spark-ignition engines have such high CO emissions. Thus, this invention will allow the combusted mixture to achieve extremely low CO levels because of the combination of ultra-lean mixtures and extended peak compression duration.

The power of this engine could be throttled by reducing the equivalence ratio, as an alternative to reducing the density of the intake charge as with current positive displacement engines with premixed air and fuel mixtures. This feature permits complete combustion to occur at low power settings up to full power, without employing the efficiency reducing step of generating a vacuum in the intake manifold at partial power settings, as in the case of conventional spark ignition piston engines. The present method could be applied with a conventional manifold throttle as well.

The method steps of the present invention realize unique and unexpected synergistic properties. Specifically, the combination of "premixing" an "ultra-lean" fuel-air combination and fully combusting at a "peak compression plateau" within a sliding vane engine geometry results in substantially reduced $NO_x$, CO, and HC emissions compared to levels achieved by current positive displacement internal combustion engines.

Each of the steps combine and interrelate to produce a result that is greater than the sum of its parts. Adequate premixing of an ultra-lean fuel-air charge prior to combustion facilitates the realization of low $NO_x$ emissions. Also, by adequately premixing the fuel-air combination, the extreme problems of particulate emissions associated with diesel engines will be avoided. In addition, the extended peak compression duration allows the ultra-lean fuel-air charge to be fully combusted which is not possible in conventional spark ignition engines. The ultra-lean fuel-air charge further allows for higher compression ratios and hotter wall temperatures to be achieved without preignition, thereby further lowering CO and HC emissions and improving fuel efficiency, thereby effectively lowering $CO_2$ emissions. Moreover, the peak compression region is of sufficient duration to permit ultra-lean combustion to occur for a practical range of operating speeds and conditions, with sufficient residence time to allow the CO and HC pollutants to almost fully oxidize.

Additionally, it is the high power density of the sliding vane geometry which allows for ultra-lean fuel-air charges to be employed without suffering the extremely heavy weight and large size per horsepower which would be associated with a piston engine if it could operate at such lean mixtures. Importantly, the vane engine design also permits the combustion residence chamber and/or continuous combustion geometry to be employed, greatly enhancing the reliability and rapidity of the combustion process, and these designs cannot be effectively employed within the piston and Wankel designs, because no physical region is continuously exposed to the combustion phase within these conventional designs. The vane geometry also uniquely permits optimization of the cycle profile with regard to shortening and custom-tailoring the compression and expansion profiles. This optimization potential permits higher compression ratios and lower leakage, for example, thereby further improving efficiency and reducing emissions.

Pollution emissions may be measured directly or approximated through conventional chemical analysis. See, for example, J. B. Heywood, *Internal Combustion Engine Fundamentals*, McGraw Hill, 1988, Chapter 11; and N. K. Rizk & H. C. Mongi, "Three-Dimensional Gas Turbine Combustor Emissions Modeling", Journal of Engineering for Gas Turbines and Power, Vol. 115, July 1993, pp. 603–619, for discussions of some equations related to pollution emissions.

Many have invested a great deal of time and money in researching the possibility of using alternative, alcohol-type fuels such as methanol and ethanol to lower certain pollutants by some degree. However, these fuels are extremely expensive compared to gasoline, do not lower emissions by a high degree, and produce high levels of aldehyde emissions. This invention overcomes these shortcomings by allowing conventional unleaded gasoline to be employed while achieving low levels of major pollutants. Though other fuels may also be used within this invention, this invention allows low pollution emission to be achieved without changing the world's gasoline supply infrastructure.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

Having thus described my invention, what I claim as new and desire to secure by Letters Patent is as follows:

1. A method for reducing exhaust pollution emissions in a sliding vane internal combustion engine, having vanes that slide with at least one of a radial and axial component of vane motion, the method comprising the steps of:

thoroughly premixing an ultra-lean fuel-air combination, said fuel-air combination having an equivalence ratio less than 0.60 and a dimensionless concentration fluctuation fraction below 0.33;

inducting the premixed, ultra-lean fuel-air combination into a vane cell;

combusting the ultra-lean fuel-air combination in the vane cell at a peak compression plateau; and purging the combusted fuel-air combination after an expansion cycle.

2. The method recited in claim 1, wherein said ultra-lean fuel-air combination has an equivalence ratio of less than 0.50.

3. The method recited in claim 2, wherein the dimensionless concentration fluctuation fraction is less than 0.10.

4. The method recited in claim 2, wherein the dimensionless concentration fluctuation fraction is less than 0.05.

5. The method recited in claim 1, wherein the step of combusting the fuel-air combination is initiated by autoignition.

6. The method recited in claim 1, wherein the step of combusting the fuel-air combination at a peak compression plateau further includes the step of providing communication between a source of hot combusted gas and a vane cell near the peak compression plateau.

7. The method recited in claim 6, wherein the step of providing communication includes a combustion residence chamber communicating with said vane cell near the peak compression plateau.

8. The method recited in claim 6, wherein the step of providing communication includes a continuous combustion geometry communicating with said vane cell near the peak compression plateau.

9. The method recited in claim 1, further including the step of adjusting power in the engine by adjusting the equivalence ratio, wherein said adjusted equivalence ratio is less than 0.60.

10. The method recited in claim 1, wherein the peak compression plateau is of sufficient duration to ensure near complete combustion of the fuel-air mixture including oxidation of CO and HC pollutants.

11. The method recited in claim 10, wherein the peak compression plateau represents at least about 10% of the compression cycle duration.

12. The method recited in claim 1, wherein the sliding vane engine utilizes a two-stroke cycle.

13. The method recited in claim 12, wherein the inducting step further includes the step of improving the scavenging cycle efficiency by providing a vane cell having a cell length at least about twice as long as the maximum cell height.

14. A method for reducing exhaust pollution emissions in a sliding vane internal combustion engine, having vanes that slide with at least one of a radial and axial component of vane motion, and incorporating effectual levels of exhaust gases or diluent gases other than fresh air in an intake charge, the method comprising the steps of:

thoroughly premixing a highly diluted fuel-gas combination, said fuel-gas combination having an equivalence ratio less than 1.0, a diluent ratio less than 0.6, and a dimensionless concentration fluctuation fraction below 0.33;

inducting the premixed, highly diluted fuel-gas combination into a vane cell;

combusting the highly diluted fuel-gas combination in the vane cell at a peak compression plateau; and purging the combusted fuel-gas combination after an expansion cycle.

15. The method recited in claim 14, wherein said highly diluted fuel-gas combination has a diluent ratio less than 0.50.

16. The method recited in claim 14, wherein said highly diluted fuel-gas combination has an equivalence ratio of less than 0.90.

* * * * *